United States Patent [19]

Farber

[11] Patent Number: 4,726,469

[45] Date of Patent: Feb. 23, 1988

[54] DISPLAY CONTAINER

[76] Inventor: Loretta L. Farber, 6922 Avondale Ct., Oklahoma City, Okla. 73116

[21] Appl. No.: 821,764

[22] Filed: Jan. 23, 1986

[51] Int. Cl.[4] ..... B65D 25/28; B65D 39/06

[52] U.S. Cl. ..... 206/493; 206/45.31; 206/301; 206/303; 215/358

[58] Field of Search ..... 206/37, 38, 44 R, 45.31, 206/45.34, 278, 303, 348, 388, 477, 478, 481, 493, 523, 566, 806, 301; 215/227, 228, 355, 358; 211/13

[56] References Cited

U.S. PATENT DOCUMENTS

| | | | |
|---|---|---|---|
| 356,524 | 1/1887 | Clement | 206/37 |
| 1,635,955 | 7/1927 | Poupart | 215/355 |
| 2,204,947 | 6/1940 | Apfelbaum | 206/37 |
| 2,295,260 | 9/1942 | Kaplan | 206/44 R |
| 2,644,453 | 7/1953 | Beacham | 215/355 |
| 2,687,731 | 8/1954 | Iarussi et al. | 215/355 |
| 2,804,203 | 8/1957 | Harkness et al. | 215/355 |
| 2,865,524 | 12/1958 | Reznek | 215/355 |
| 4,120,401 | 10/1978 | Newman | 206/566 |
| 4,165,814 | 8/1979 | Seel | 206/806 |

*Primary Examiner*—Jimmy G. Foster
*Attorney, Agent, or Firm*—Larson & Taylor

[57] ABSTRACT

A display container for displaying a product such as jewelry and watches. The container includes a transparent cylindrical tube and two spherical sponge rubber end caps mountable at least partially inside the ends of the tube. A strap extends through the top end cap and has a loop on the outer side thereof so that the container can be hung from a stand or other support. A hook is mounted to the inside end of the top cap, preferably to the inner end of the strap, onto which the product is hung.

8 Claims, 7 Drawing Figures

DISPLAY CONTAINER

FIELD OF THE INVENTION

The present invention relates in general to containers and more specifically relates to a display container for both protectingly containing and displaying individual consumer products such as jewelry and watches.

BACKGROUND OF THE INVENTION

The consumer packaging industry is constantly trying to accomplish a number of what appear to be contradictory goals. Some of these goals include a container that protects the goods; a container that displays the goods directly to the consumer; a container that is attractive; a container that is made from inexpensive materials; a container that is inexpensively assembled; a container that permits economical placement of the goods inside; and a container that is easy for the consumer to open; a container that is difficult for a shoplifter to open; and a container that will show if it has been tampered with. In the jewelry and watch industry, particularly the novelty section thereof, it is extremely important for the package to be eye-catching, attractive, innovative, and yet still functional so that the jewelry and watches can be attractively and innovatively displayed. While there are some containers that meet some of these objectives, there really are very few containers which meet all of them.

SUMMARY OF THE INVENTION

Accordingly, it is an objective of the present invention to meet all of the aforementioned desirable features, yet still be extremely modern, attactive, and durable. Another objective of the present invention is to be flexible in size and configurations so that a wide variety of sizes, shapes and configurations of jewelry and watches can be packaged without incurring a large number of different sized packages.

A container for displaying a product according to the present invention that provides these features, yet overcomes the disadvantages of the prior art includes an elongate shell having an elongate bore therethrough defined by a bore wall. The shell has an opening in at least one end so as to permit access to the bore. An end closure is removable mountable on the shell and when mounted thereon closes the opened shell end. The end closure is comprised of a resilient material and has an effective diameter larger than the effective diameter of the end opening. The effective diameter and the resiliency of the material is selected so as to permit a part of the material to be inserted into the tube bore and sealingly expand against the bore wall. The remainder of the material remains outside the shell in an uncompressed state. A hanger means for mounting one end of the product is mounted to the end closure so as to be located inside the bore when the end closure is mounted on the shell and to extend inwardly therefrom in said bore.

In a particular embodiment of the present invention, the container is a transparent, hollow cylinder and has similar end closures at each end. In this particular embodiment of the invention, the end closures are made of sponge rubber and the end closure to which the hanger means is attached further includes an attachment means, which can be a strap, for vertically hanging the container from a support stand. In this manner, the product, such as a watch, will hang vertically from the hanger means.

In another embodiment of the present invention, the sponge rubber end closures are securely mounted to the shell by means such as glue located between the inner cylindrical wall and the expanded inserted portion of the end closure.

These and other objectives, features and advantages of the present invention are set forth in or are apparant from the detailed disclosure of the presently preferred embodiments contained hereinbelow.

DETAILED DESCRIPTION OF THE PRESENTLY PREFERRED EMBODIMENTS

Figure 1:
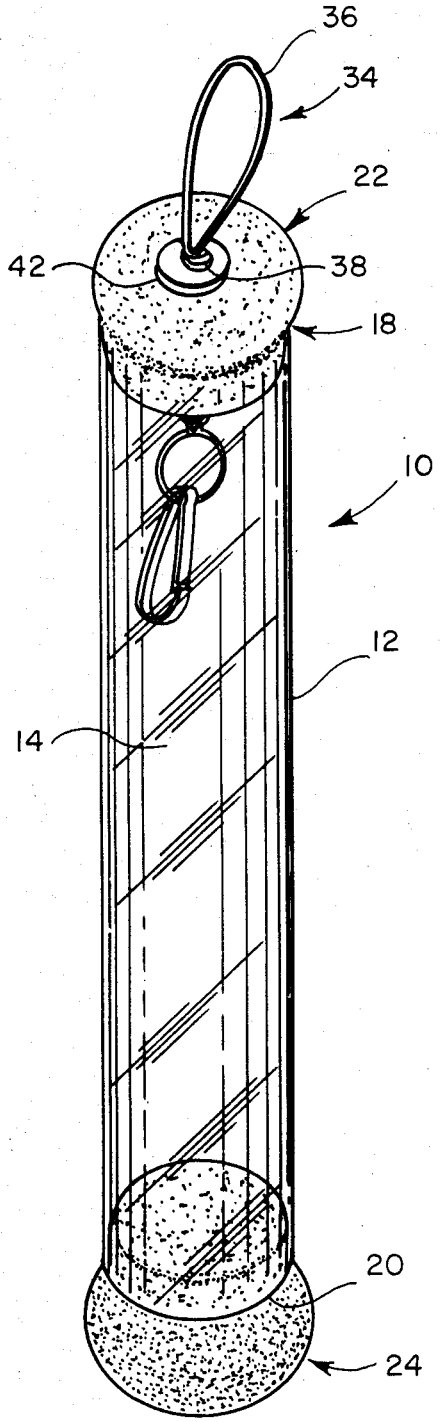
FIG. 1 is a full perspective view of a display container according to a first embodiment of the present invention.
Figure 3:
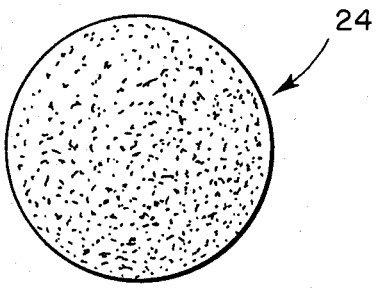
FIG. 3 is a bottom plan view of the display container depicted in FIG. 1.
Figure 4:
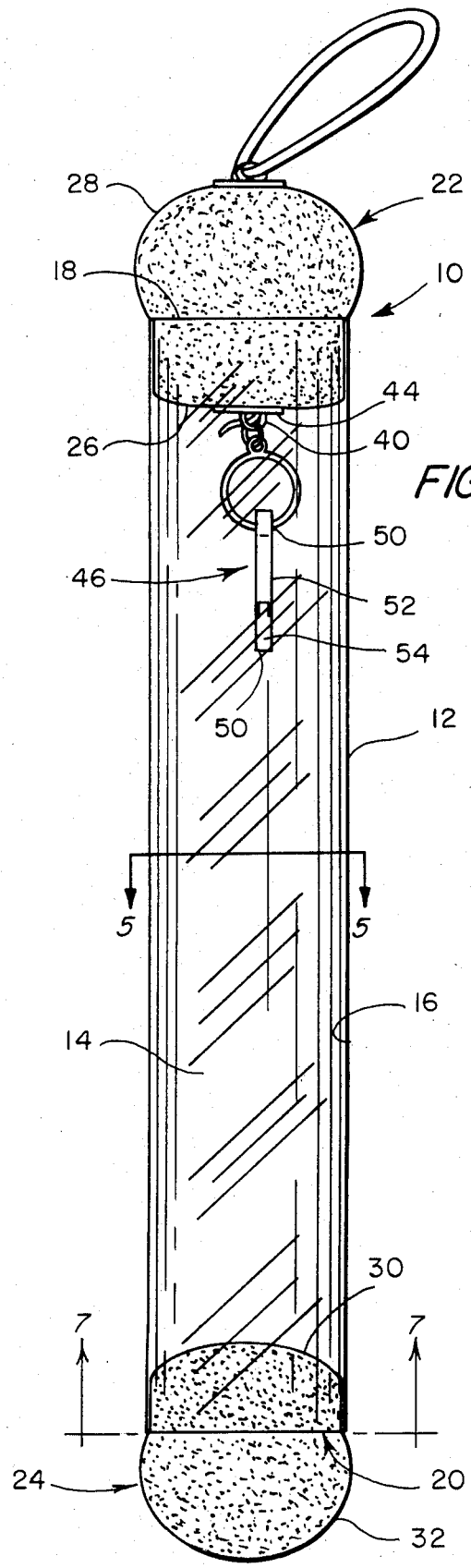
FIG. 4 is a back elevational view of the display container depicted in FIG. 1.
Figure 5:
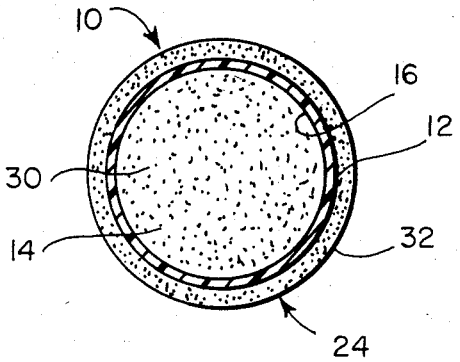
FIG. 5 is a cross-sectional view taken along lines 5—5 of FIG. 4.

With reference now to the Figures wherein the same numerals are used to depict like elements throughout the several views, and in particular with reference to FIGS. 1, 4 and 5, a display container 10 is depicted. Display container is comprised of a hollow, right circular cylindrical shell or tube 12 having a bore 14 defined by an inner tube wall 16, and open at a top end 18 and open at a bottom end 20. Tube 12 is made of a transparent, rigid material such as a polymeric plastic (e.g. polyethylene, polypropylene and polyvinyl) or a glass. Preferably, the selected material is not breakable and is shatter-proof. Such materials are conventional and are readily available on the market. For safety purposes, the end edges at ends 16 and 18 are not sharp, but are rounded. The thickness of tube wall 16 can be any selected size, which would vary with the type of material from which it is made. In the presently preferred embodiment, the tube wall thickness is selected so as to make the tube slightly flexible, but not completely crushable.

Two end closures or caps, a top cap 22 and a bottom cap 24, securely seal the open tube ends 18 and 20. Preferably, caps 22 and 24 are identical and are spherical and made of a sponge rubber material having a diameter that is greater than the diameter of the corresponding tube top and bottom ends 18 and 20. The sponge rubber material preferably has a compressibility, resiliency and diameter such that a portion can be compressed and inserted into the corresponding tube end 18 or 20, and when released will expand against tube wall 16. As can be seen in FIGS. 1 and 4, top cap 22 has an overall mushroom appearance with a stem portion 26 that is inserted inside tube 12 and a cap portion 28 that is outside tube 12. Similarly, bottom cap 24 has a stem portion 30 and a stem portion 32. Obviously, if desired, caps 22 and 24 can be pushed completely inside tube 12 and thereby eliminate the mushroom effect. In a presently preferred embodiment, top cap and bottom cap have a color, such as a bright yellow. It is also presently preferred that at least the outside of the stem portions 26 and 30 have a roughened surface so as to increase the friction with tube wall 16 and to increase the amount of force required to remove caps 22 and 24.

Figure 2:
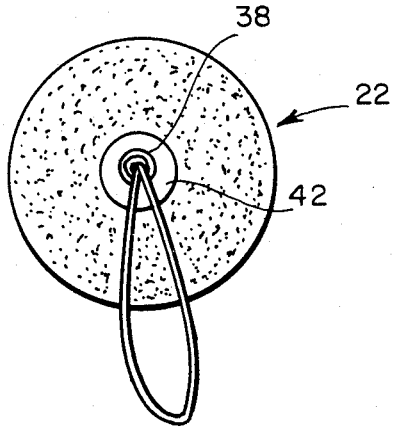
FIG. 2 is a top plan view of the display container depicted in FIG. 1.

As depicted in FIGS. 1, 2 and 4, a cord 34 extends completely through top cap 22 and has an upper loop portion 36 that extends above top cap portion 32 and which can be used to suspend display container 10 from a stand or rack (not shown). Cord 34 has a means, such as an upper knot 38 and a lower knot 40, to prevent cord 34 from being removed from top cap 22. Additionally, cord 34 extends through the central openings of an upper circular washer 42 and a lower circular washer 44, located between upper knot 38 and top cap 22 and between lower knot 40 and top cap 22, respectively. Washers 42 and 44 provide additional means to prevent cord 34 from being removed from top cap 22. In addition, cord 34 can be looped around or tied around washers 42 and 44. Obviously, other means can be used to prevent the withdrawal of cord 34 from top cap 22, such as an adhesive or a fastening means (e.g. a staple).

Mounted inside tube bore 14 is a hanger means from which a product, such as a watch (not shown) can be attached or hung. In the presently preferred embodiment as depicted in FIGS. 1 and 4, the hanger means is a snap hook 46 having an enlarged end 48 and an attachment end 50. One side of hook 46 has a transverse break therethrough located in enlarged end 48. A lever member 52 is located on one side of the break and and an overlapping catch 54 is located on the other side of the break. Hook attachment end 50 is mounted on a solid mounting ring 56, which in turn is mounted on a split washer wire 58. Split washer wire 58, in the presently preferred embodiment, is tied onto cord 34. Hook 46 and mounting ring 56 can be made of any rigid, relatively strong material, which preferably is nontoxic and nonreactive with the product (e.g. jewelry or watches) to be hung therefrom. For example they can both be made of a plastic material that is colored the same color as top and bottom caps 22 and 24. They can also be made of a metal that is coated with a material such as chromium or enamel, or of a solid nonreacting metal.

Figure 6:
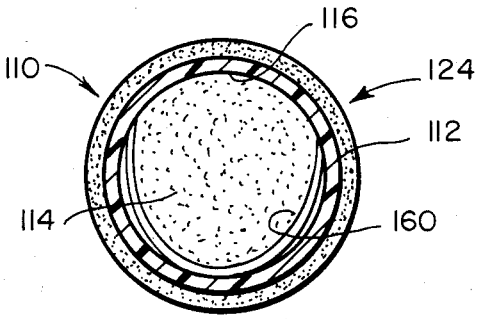
FIG. 6 is a cross-sectional view similar to FIG. 5, but depicting a second embodiment of the invention.

In FIG. 6, a modified display container 110 is depicted. Display container 100 is comprised of a transparent tube 112 having a bore 114 defined by an inner tube wall 116 and a top and bottom cap, only bottom cap 124 being depicted. Display container 110 is the same as display container 10, except that it also includes a means to block part of the transparent view through tube 112. In the embodiment depicted in FIG. 6, the blocking means is comprised of a piece of opaque paper 160 having a width such that it does not extend completely around the inner circumference of wall 116 and having a length such that it does not extent the entire length of tube 112 so that the end caps can be inserted into tube 112. Preferably, paper 160 has a picture or pattern thereon so as to add to the decorative appearance of container 110. Alternatively, the blocking means can be an inner or outer coating on tube 12.

Figure 7:
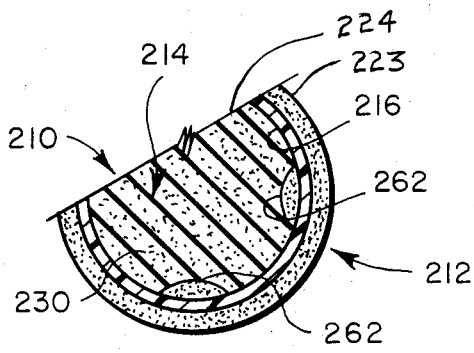
FIG. 7 is a partial cross-sectional view of yet another embodiment of the present invention which is taken along a line such as lines 7—7 of FIG. 4.

With reference now to FIG. 7, a third embodiment of a display container 210 is depicted. Display container 210 is comprised of a transparent cylindrical tube 212 having a bore 214 therein defined by an inner tube wall 216. Display container also includes a top cap 223 and a bottom cap 224. Bottom cap 224 includes a cap portion (not shown) and a stem portion 230. Display container 210 is the same as display container 10 except that it also includes means for retaining the top cap and bottom cap 224 mounted to tube 212. In the embodiment depicted in FIG. 7, the retaining means comprises a spot adhesive 262 applied in various spots between inner tube wall 216 and the outside of cap stem portion 230. Obviously, other means can be used such as an adhesive tape applied between the corresponding cap portion of top cap and bottom cap and the top end and bottom end of the container tube. Other means include a fastener, such as a staple, rivet or screw, or a cap having the stem portion thereof coated with an adhesive.

The present invention has been described with respect to presently preferred embodiments thereof. Other variations, modifications, changes, and additional features with the scope of the appended claims would be apparent to those skilled in the art.

I claim:

1. A container for displaying a product being sold comprising:

an elongate cylindrical shell having first and second ends and an elongate bore therethrough defined by a bore wall and an opening in at least said first shell end so as to permit access to said bore, said shell being comprised at least in part of a transparent material so that the contents inside said shell can be seen from the outside thereof;

a first end closure that is substantially spherical when in the uncompressed state and is removably mountable on said shell and comprised of a resilient material, said material having an effective diameter larger than the effective diameter of said end opening, the effective diameter and the resiliency of said material being such so as to permit part of said material to be inserted into said tube bore and expand against said bore wall, and the remainder of said material to remain outside said shell;

and a hanger means onto which a product can be attached is mounted to said first end closure so as to be located inside said bore when said end closure is mounted on said shell.

2. The display container as claimed in claim 1 wherein said end closure is comprised of a sponge rubber material that is easily compressible; and wherein said container further comprises:

adhesive means for securing said end closure in said first end.

3. The container as claimed in claim 1 wherein said shell has a second opening therein located at said second end thereof so as to permit access to the other end of said bore; said container further comprising:

a second end closure removably mountable on said shell at said second end and comprised of a resilient material, said material having an effective diameter larger than the effective diameter of said second end opening, the effective diameter and the resiliency of said material being such so as to permit part of said material to be inserted into said tube bore at said second end and expand against said bore wall, and the remainder of said material to remain outside said shell.

4. The container as claimed in claim 3 and further including attachment means attached to said container by which said container can be hung from a support.

5. The container as claimed in claim 4 wherein said attachment means is mounted on said first end closure.

6. The container as claimed in claim 5 wherein said attachment means is a strap, one end of which extends through said first end closure; and further including means for securing said strap one end to prevent the withdrawal thereof from said first end closure.

7. The container as claimed in claim 6 wherein said hanger means comprises a clip that is mounted to said one end of said strap.

8. A container for displaying a product comprising:

an elongate shell having first and second ends and an elongate bore therethrough defined by a bore wall and an opening in both ends thereof so as to permit access to said bore from each end, said shell being comprised at least in part of a transparent material so that the contents inside said shell can be seen from the outside thereof;

first and second end closures removably mountable on said first and second ends, respectively, of said shell, each end closure comprised of a resilient material, said material having an effective diameter larger than the effective diameter of said end opening, the effective diameter and the resiliency of said material being such so as to permit part of said material to be inserted into said tube bore and expand against said bore wall, and the remainder of said material to remain outside said shell;

attachment means mounted on said container first end closure by which said container can be hung from a support, said attachment means being a strap, one end of which extends through said first end closure;

means for securing said strap one end to prevent the withdrawal thereof from said first end closure;

and a hanger means onto which a product can be attached is mounted to said first end closure so as to be located inside said bore when said end closure is mounted on said shell, said hanger means comprising a clip that is mounted to said one end of said strap.

* * * * *